US007866241B2

(12) United States Patent
Yu Chen

(10) Patent No.: US 7,866,241 B2
(45) Date of Patent: Jan. 11, 2011

(54) CUTTER FOR CUTTING A COILED BAND

(76) Inventor: Hsiu-Man Yu Chen, No. 40, Sec. 1, Ta Fu Road, Tan Tzu Hsiang Taichung (TW) 427

( * ) Notice: Subject to any disclaimer, the term of this patent is extended or adjusted under 35 U.S.C. 154(b) by 402 days.

(21) Appl. No.: 11/864,883

(22) Filed: Sep. 28, 2007

(65) Prior Publication Data

US 2009/0084239 A1 Apr. 2, 2009

(51) Int. Cl.
*B26D 7/00* (2006.01)

(52) U.S. Cl. ..... 83/649; 83/454; 83/485; 83/455

(58) Field of Classification Search ..... 83/649, 83/650, 614, 485, 454, 455, 648
See application file for complete search history.

(56) References Cited

U.S. PATENT DOCUMENTS

| | | | | | |
|---|---|---|---|---|---|
| 559,795 | A * | 5/1896 | Frank | 83/451 |
| 3,077,805 | A * | 2/1963 | Stanley | 83/384 |
| 3,529,504 | A * | 9/1970 | Hagerty et al. | 83/464 |
| 3,540,337 | A * | 11/1970 | Gardner | 83/451 |
| 3,659,487 | A * | 5/1972 | Henderson | 83/447 |
| 3,788,175 | A * | 1/1974 | Davis | 83/83 |
| 3,821,915 | A * | 7/1974 | Larrable | 83/174 |
| 3,987,603 | A * | 10/1976 | Jelling et al. | 53/459 |
| 4,344,551 | A * | 8/1982 | Albin | 225/86 |
| 5,103,710 | A * | 4/1992 | Ross | 83/485 |
| 5,121,885 | A * | 6/1992 | Chipman | 242/525.1 |
| 5,287,783 | A * | 2/1994 | Mori | 83/455 |
| 5,442,983 | A * | 8/1995 | D'Angelo et al. | 83/56 |
| 5,927,173 | A * | 7/1999 | Lyons et al. | 83/650 |
| 7,124,674 | B2 * | 10/2006 | Maxey | 83/649 |
| 7,395,640 | B1 * | 7/2008 | Wang | 53/389.3 |

* cited by examiner

*Primary Examiner*—Boyer D. Ashley
*Assistant Examiner*—Omar Flores-Sánchez
(74) *Attorney, Agent, or Firm*—Ming Chow; Sinorica, LLC

(57) ABSTRACT

A cutter for cutting a coiled band includes a main body, and a cutting base installed on the main body, having a rectangular frame and a cutting groove formed in the long bottom side of the frame. Respectively fixed at one side and two ends of the cutting base is a sliding plate that has a sliding rail pivotally connected with two ends of a pressing rod respectively, so as to let the front end of the coiled band pass under the pressing rod to run out of the frame while having the pressing rod lifted up. Then, the pressing rod is released to press on the coiled band so as to let a knife unit pivotally connected with the main body flatly and securely cut the coiled band. The cutter is convenient and safe to use, with a cut band being flat and straight.

8 Claims, 7 Drawing Sheets

CUTTER FOR CUTTING A COILED BAND

BACKGROUND OF THE INVENTION

1. Field of the Invention

This invention relates to a cutter, particularly to one used for cutting a coiled band.

2. Description of the Prior Art

Conventionally, if a coiled band is to be cut, its size desired has to be measured first and then, use a table cutter or knife to cut it. It is always time-consuming and inconvenient, especially for cutting a large size. Moreover, hands are possible to be hurt.

SUMMARY OF THE INVENTION

The objective of this invention is to offer a cutter for cutting a coiled band.

The main characteristics of the invention are a main body, a cutting base and a knife unit. The cutting base is installed on the main body, provided with a rectangular frame, a cutting groove formed in the long bottom side of the frame, and a sliding plate fixed at one side and two ends of the cutting base respectively. Each of the sliding plates is provided with a sliding rail having its circumference pivotally connecting with two ends of a pressing rod respectively, so as to let the front end of the coiled band pass under the pressing rod to run out of the frame while having the pressing rod lifted up. Then, the pressing rod is released to press on the coiled band so as to let the knife unit pivotally engaged with the main body flatly and securely cut the coiled band.

BRIEF DESCRIPTION OF DRAWINGS

This invention is better understood by referring to the accompanying drawings, wherein.

DETAILED DESCRIPTION OF THE PREFERRED EMBODIMENT

Figure 1:
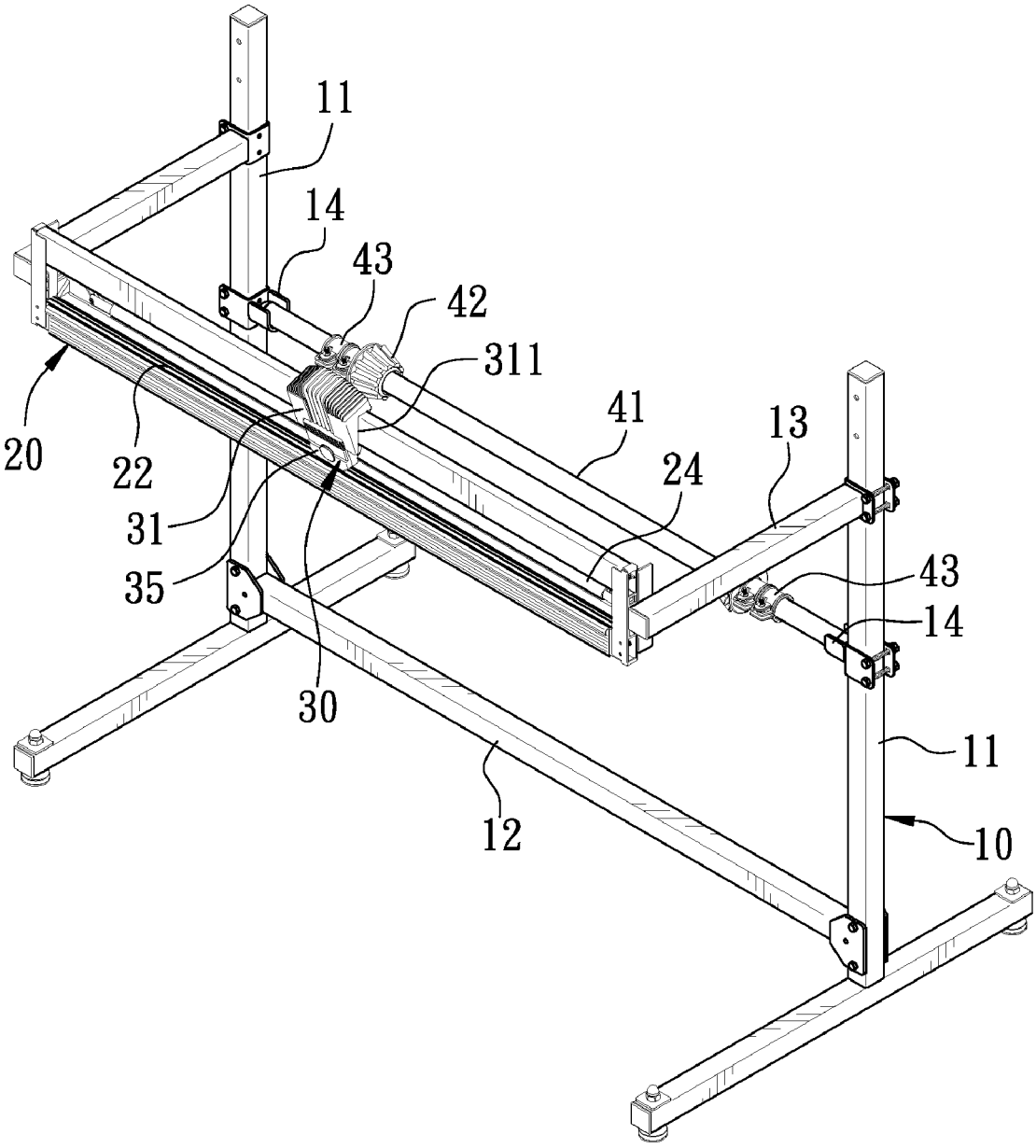
FIG. 1 is a perspective view of a first preferred embodiment of a cutter for cutting a coiled band in the present invention.
Figure 2:
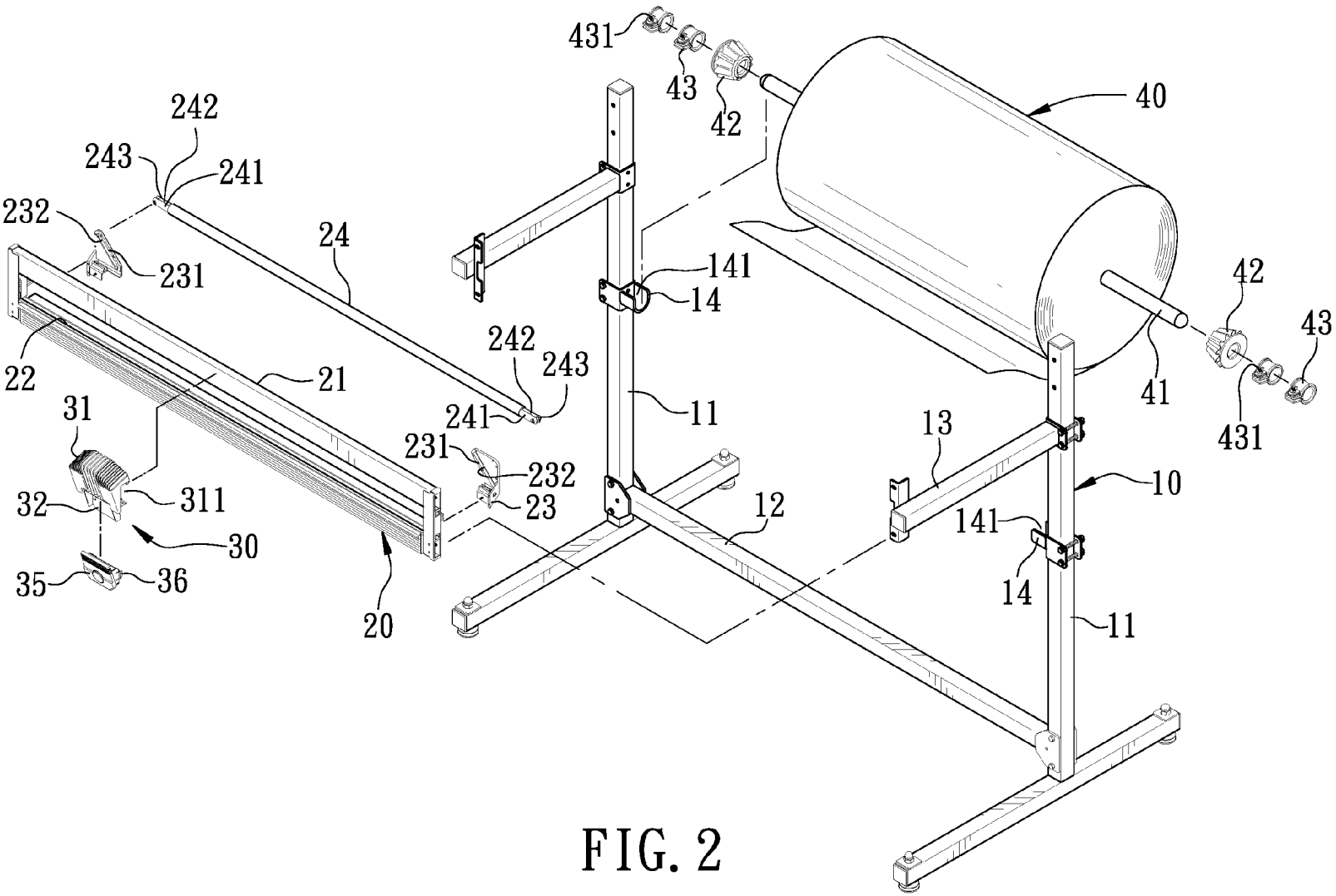
FIG. 2 is an exploded perspective view of the first preferred embodiment of a cutter for cutting a coiled band in the present invention.

As shown in FIGS. 1 and 2, a first preferred embodiment of a cutter for cutting a coiled band in the present invention includes a main body 10, a cutting base 20 and a knife unit 30.

The main body 10 is vertically placed on the ground, provided with a T-shaped post 11 formed at its two sides respectively, reversely standing on the ground in parallel. A transverse rod 12 has its two ends connected to the bottom center of the T-shapes posts 11 respectively, and a front rod 13 is fixed at a preset position of each of the T-shaped posts 11 near the top, extended forward and parallel with each other. The main body 10 is also provided with a U-shaped supporter 14 that is located at a proper position of each of the T-shaped posts 11 below the front rod 13, having an opening facing upward and corresponding to each other. The U-shaped supporters 14 are employed to support two ends of a shaft 41 of a coiled band 40. The shaft 41 has its two ends pivotally engaged with a conical restricting block 42 respectively, which is installed with two adjusting rings 43 at its rear end. Each of the adjusting rings 43 is provided with an adjusting screw 431 formed at its one side. Clamped by the restricting blocks 42 and tightened by the adjusting rings 43, the coiled band 40 is not to move horizontally along the shaft 41 while being pulled out with a certain length for being cut.

The cutting base 20 has its two ends respectively fixed at the front end of the front rod 13, positioned higher than and in front of the coiled band 40 in a proper distance. The cutting base 20 is provided with a long rectangular frame 21, a cutting groove 22 formed in the long bottom side of the frame 21 with an opening facing upward, and a triangular sliding plate 23 fixed horizontally at the rear side of its two short sides respectively. The sliding plates 23 are respectively provided with a bevel 231 parallel with each other, and a rectangular sliding rail 232 that is formed in each of the bevels 231, having an arc-like upper edge and an arc-like bottom edge, and tilted leftward to be parallel with each other. A pressing rod 24 has its two ends pivotally connected to the circumference of the bevels 231 for flatly pressing in a balanced condition the coiled band 40 of different materials, able to be moved manually to obliquely slide along the sliding rails 231 behind the cutting base 20, so as to adapt to a variety of thickness of the coiled bands 40. The pressing rod 24 is provided with a joint 241 formed at its two ends respectively, an opening 242 concaved in each of the connecting heads 241 to face to the bevel 231 of the sliding plate 23, and a bar 243 inserted through the opening 242. So, by means of the openings 242 respectively connected on the circumference of the bevels 231 of the sliding rails 232 of the sliding plates 23, the pressing rod 24 can slide up and down along the bevels 231.

Figure 3:
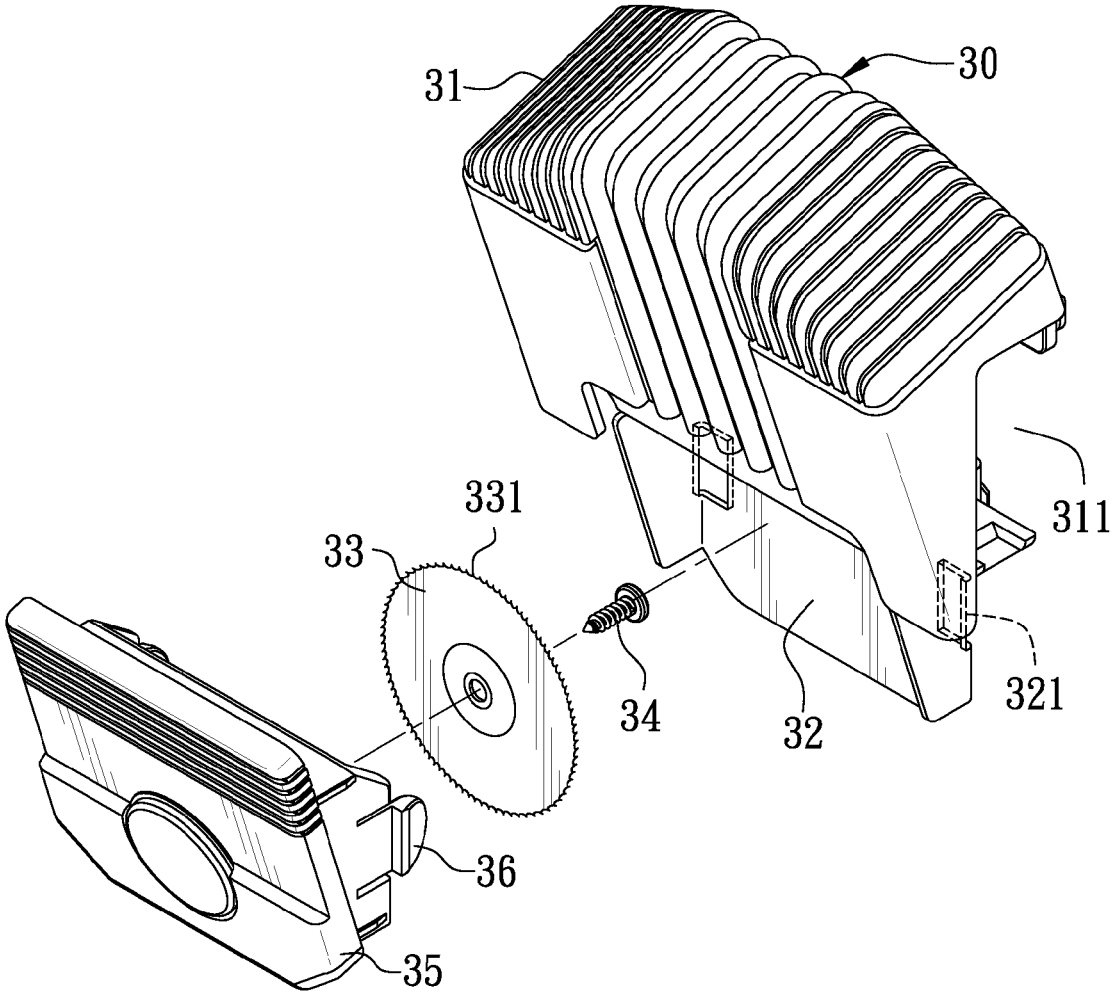
FIG. 3 is an exploded perspective view of a knife unit of the first preferred embodiment of a cutter for cutting a coiled band in the present invention.
Figure 4:
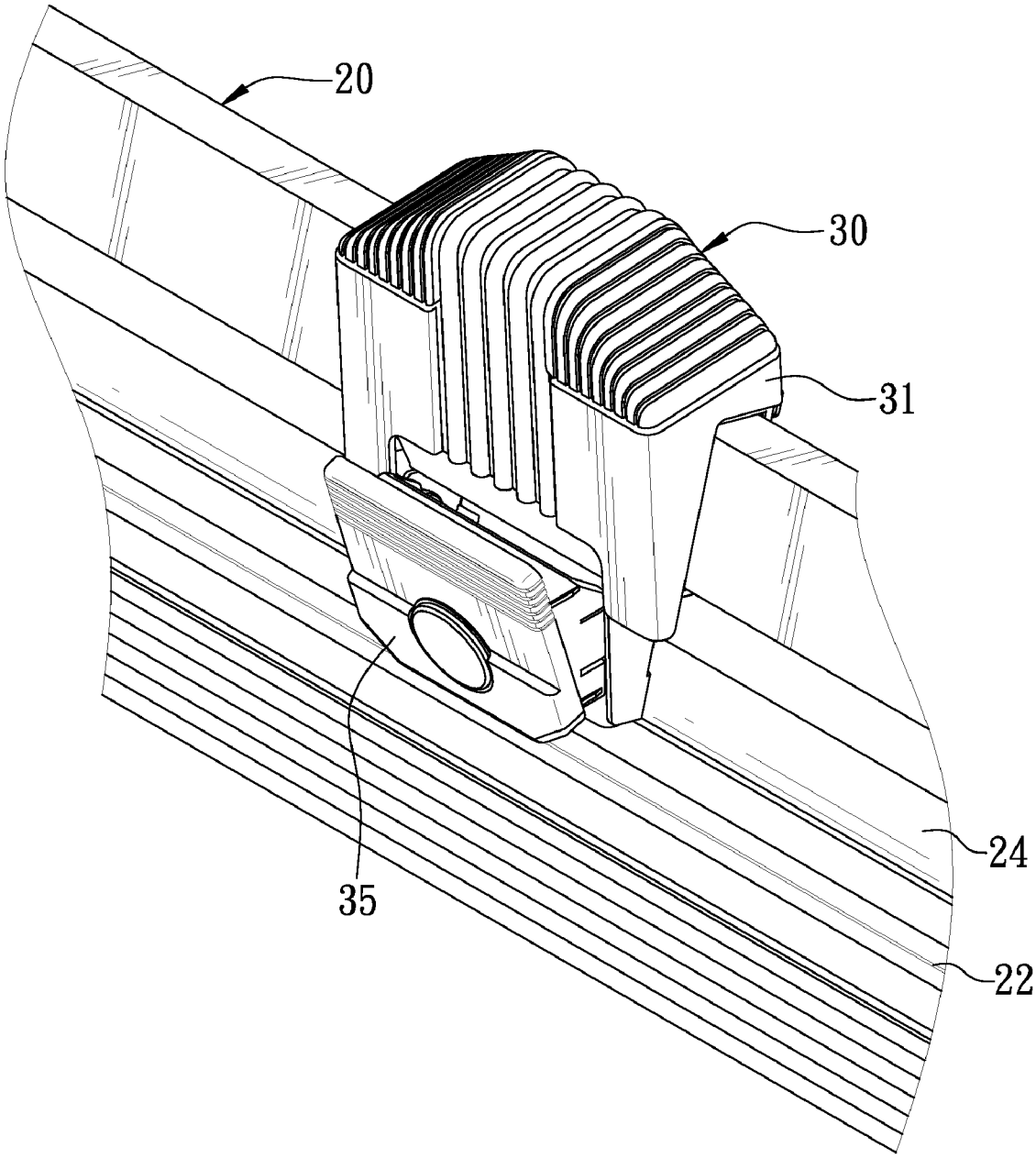
FIG. 4 is a perspective view of the knife unit of the first preferred embodiment of a cutter for cutting a coiled band in the present invention.

The knife unit 30 is provided with a knife base 31 formed as a rectangular shell, which is provided with a groove 311 formed horizontally at its one side for pivotally connected to the front top edge of the cutting base 20, and a plate member 32 extended downward from the rear side of the bottom of the knife base 31 to correspond to one side of the pressing rod 24. The plate member 32 is provided with a notch 321 formed at its two sides respectively. With reference to FIG. 3, the knife unit 30 is also provided with a circular knife 33 that is threadably fixed at one side of a knife grip 35 by means of a screw 34, provided with plural pointed teeth 331 formed around its circumference and equidistantly spaced apart closely. The knife 33 has its bottom portion extended out of the knife grip 35 to cut the coiled band 40 such as a coiled foamed plastics sheet and all kinds of wallpaper sheet etc. And, as shown in FIG. 4, with the bottom of the knife 33 just accommodated in the cutting groove 22, it can simultaneously slide along the cutting groove 22 horizontally as the knife base 31 is moving along the top side of the cutting base 20. An elastic semicircular locking ear 36 is horizontally extended out from two sides of the knife grip 35 respectively, with a thickness coincident to the width of the notch 321, so that the knife grip 35 can be stably assembled together with the plate 32 by the locking ears 36 elastically inserted into the notches 321. Thus, the bottom of the knife 33 is restrictively confined in the cutting groove 22.

In using, if foamed plastics sheet is to be cut, the procedure can be divided into five steps as described below.

The first step (1) is to primarily move the knife unit 30 to one side of the cutting base 20 and then, slightly press the locking ears 36 of the knife grip 35 with fingers to keep the knife grip 35 released from the plate 32.

The second step (2) is to first keep the knife grip 35 assembled with the circular knife 33 for cutting the foamed plastics sheet and next, put the screw 34 fixed on the knife grip 35 to keep the knife 33 immovable. Then, keep the portion of the knife 33 extending out of the knife grip 35 accommodated in the cutting groove 22 correspondingly located below the cutting base 31. Then press the locking ears 36 of the knife grip 35 to enter the notches 321, so as to enable the knife grip 35 restrictively assembled with the plate 32 of the cutting member 30.

The third step (3) is to insert the shaft 41 through the coiled band 40 of the foamed plastics sheet and then, keep two ends of the shaft 41 rested on the supporters 14. The restricting block 42 are successively moved to clamp the center of two sides of the coiled band 40, making the coiled band 40 located centrally at the shaft 41.

Figure 5:
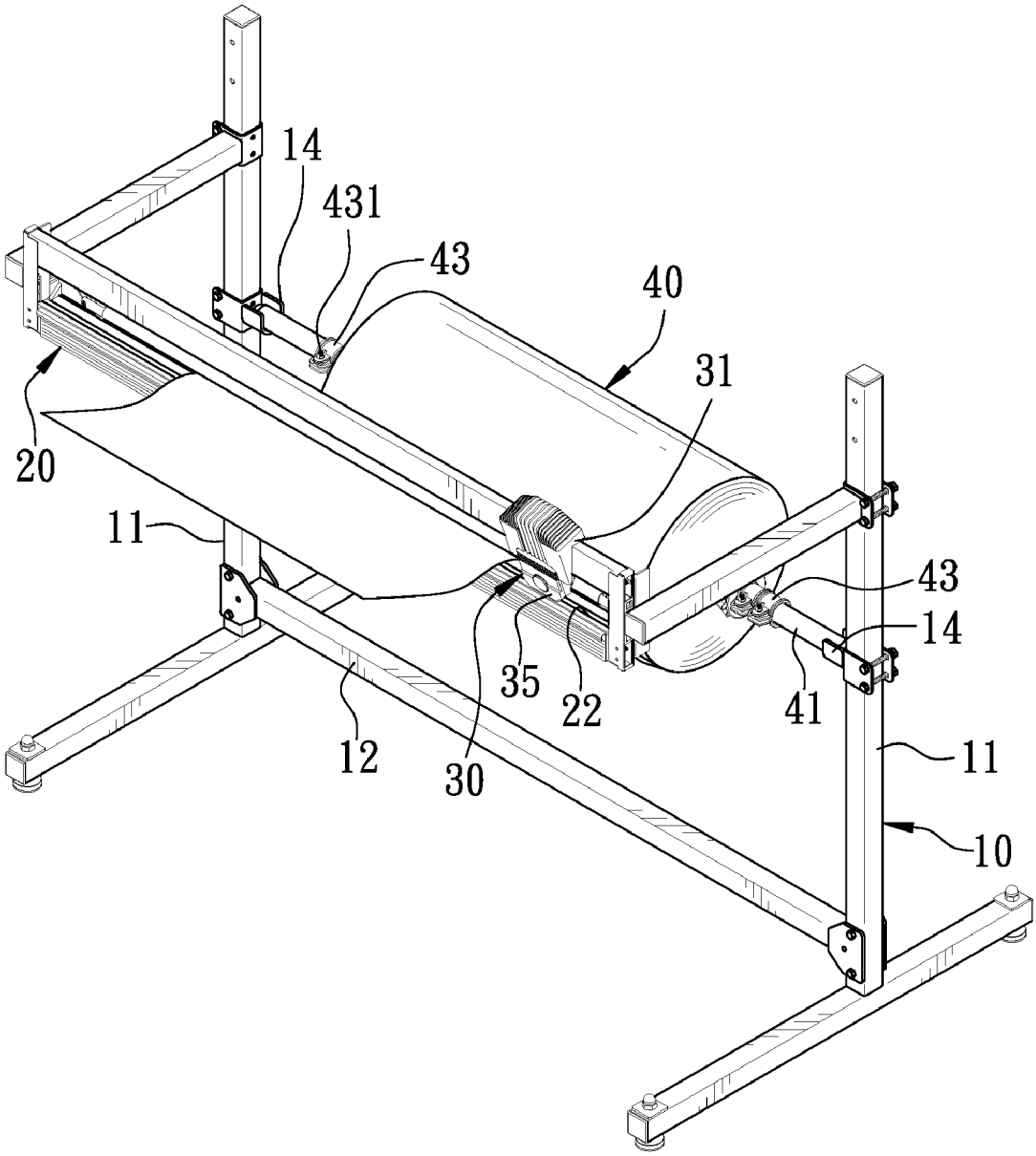
FIG. 5 is a front perspective view of the first preferred embodiment of a cutter for cutting a coiled band in the present invention, showing it being operated.
Figure 6:
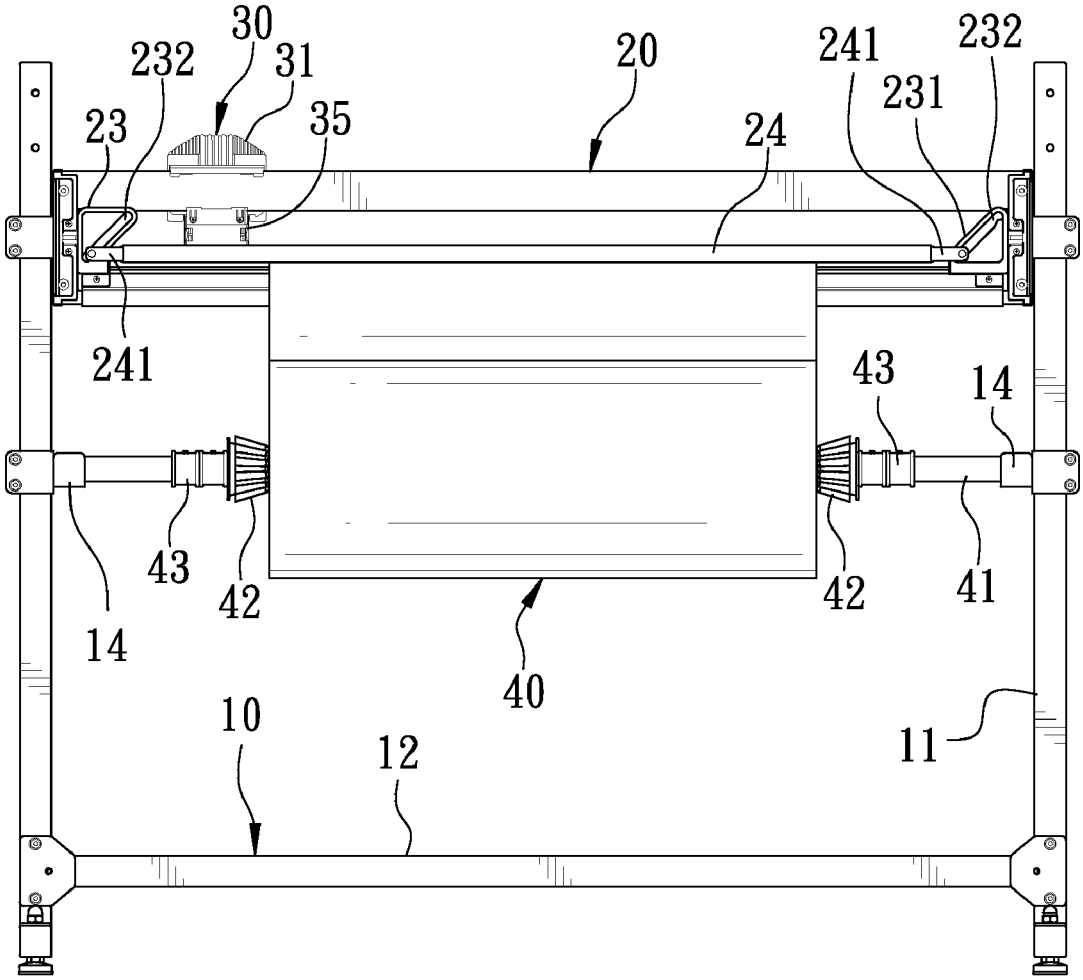
FIG. 6 is a rear view of the first preferred embodiment of a cutter for cutting a coiled band in the present invention, showing it being operated.

The fourth step (4) is to pull out the coiled band 40 with a desired length and lift up the pressing rod 24 to let the coiled band 40 pass under the pressing rod 24 to run out of the front side of the frame 21, as shown in FIG. 5. Then, as shown in FIG. 6, release the pressing rod 24 to let it press on the coiled band 40 that is successively positioned at its two ends by the adjusting rings 43 to restrict it from moving horizontally.

The fifth step (5) is to start moving the cutting base 20 horizontally, keeping the knife 33 moved along the cutting groove 22 to horizontally cut a needed portion from the coiled band 40. A swift and force-saving cutting job is thus finished.

Figure 7:
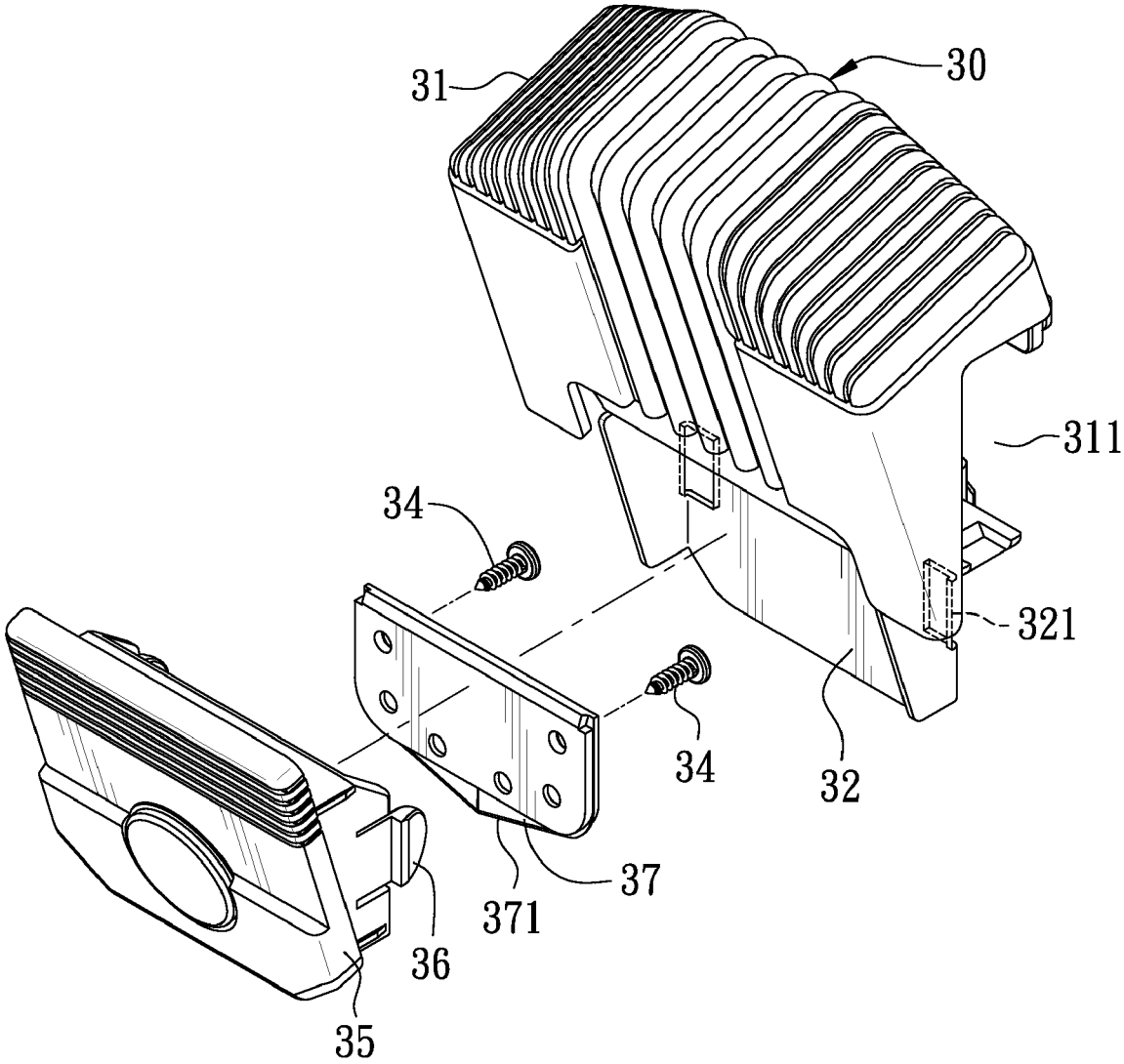
FIG. 7 is an exploded perspective view of a knife unit of a second preferred embodiment of a cutter for cutting a coiled band in the present invention.

As shown in FIG. 7, a second preferred embodiment of a cutter for cutting a coiled band in the present invention has the same components and functions as the first one does, except that the knife 37 is shaped rectangular, threadably positioned on one side of the knife grip 35 by two screws 34, and provided with a sharp cutting edge 371 formed at its bottom to carry out cutting.

The advantages of the invention are described below as can be seen from the foresaid description.

It is very convenient and secure to use the invention to cut the coiled band 40. And, the knife 33 can be alternately replaced with diverse ones to cut different sorts of the coiled band 40.

While the preferred embodiment of the invention has been described above, it will be recognized and understood that various modifications may be made therein and the appended claims are intended to cover all such modifications that may fall within the spirit and scope of the invention.

What is claimed is:

1. A cutter for cutting a coiled band comprising:

a main body placed on a ground and provided with a supporter located at a proper position at its two sides respectively for supporting two ends of a shaft that is inserted with a coiled band;

a cutting base having its two ends positioned at proper locations of a top of said main body and provided with a rectangular frame;

a cutting groove formed in a long bottom side of said rectangular frame;

a sliding plate fixed horizontally at a rear side of two short sides of said cutting base respectively;

a sliding rail formed in each of said sliding plates and tilted leftward to be parallel with each other;

a pressing rod has its two ends slidably connected to a circumference of said sliding rails to be able to move obliquely up and down along one side of said cutting base;

a knife unit provided with a knife base that has a groove formed horizontally at its one side for slidably connected to a top long side of said cutting base;

a plate extended downward from a bottom rear side of said knife base to correspond to one side of said pressing rod for positioning with a knife to keep a bottom of said knife extended out to be accommodated in said cutting groove of said cutting base;

said knife able to be simultaneously moved along said cutting groove while said knife base is horizontally moved along a top side of said cutting base;

said pressing rod is provided with a joint formed at its two ends respectively;

an opening concaved in each of said joint to face to said sliding plates;

a bar inserted through said opening; and said pressing rod able to slide along edges of said sliding rails by means of said joints.

2. The cutter for cutting a coiled band as claimed in claim 1, wherein said sliding plates of said cutting base are formed triangular and respectively fixed at one side of two ends of said cutting base.

3. The cutter for cutting a coiled band as claimed in claim 1, wherein said main body is provided with a T-shaped post formed at its two sides respectively, said T-shaped posts reversely standing on a ground in parallel, a transverse rod having its two ends connected to a bottom center of said T-shapes posts respectively, a front rod fixed at a proper top position of each of said T-shaped posts and extended forward to be parallel with each other, a front end of each of said front rod connected with two ends of said cutting base respectively, an U-shaped supporter located at a proper position of each of said T-shaped posts below said cutting base and having an opening facing upward and corresponding to each other, said U-shaped supporters employed to support two ends of said shaft.

4. The cutter for cutting a coiled band as claimed in claim 1, wherein said shaft has its two ends pivotally mounted with a restricting block respectively for keeping a coiled band positioned centrally, two adjusting rings set at a rear of each of said restricting block.

5. The cutter for cutting a coiled band as claimed in claim 1, wherein said knife base of said knife unit is formed as a shell and provided with two notches respectively cut at two sides of said plate.

6. The cutter for cutting a coiled band as claimed in claim 5, wherein said knife has its center threadably fixed at one side of a knife grip by a screw to keep its bottom portion extended out of said knife grip, an elastic semi-circular locking ear 36 horizontally extended out from two sides of said knife grip respectively for corresponding to said notches.

7. The cutter for cutting a coiled band as claimed in claim 5, wherein said knife is a circular one and provided with plural pointed teeth formed around its circumference and equidistantly spaced apart closely.

8. The cutter for cutting a coiled band as claimed in claim 5, wherein said knife is a rectangular one and provided with a sharp cutting edge formed in a lower portion of said knife extended out of said knife grip.

* * * * *